United States Patent [19]

Sakamoto

[11] 4,249,157

[45] Feb. 3, 1981

[54] VARIABLE IMPEDANCE DEVICE

[75] Inventor: Nozomu Sakamoto, Tokyo, Japan

[73] Assignee: Alps Electric Co., Ltd., Tokyo, Japan

[21] Appl. No.: 25,735

[22] Filed: Mar. 30, 1979

[30] Foreign Application Priority Data

Mar. 30, 1978 [JP] Japan ..... 53-37134

[51] Int. Cl.[3] ..... H01C 10/38

[52] U.S. Cl. ..... 338/176; 338/128; 338/202; 338/334; 338/320

[58] Field of Search ..... 338/125–129, 338/135, 124, 160–162, 185, 171, 176, 180, 202, 320, 334; 323/74, 76; 357/51

[56] References Cited

U.S. PATENT DOCUMENTS

| | | | |
|---|---|---|---|
| 2,518,225 | 8/1950 | Dorst | 338/334 X |
| 3,221,215 | 11/1965 | Osatune et al. | 357/51 |
| 3,258,723 | 6/1966 | Osatune et al. | 357/51 X |
| 3,337,831 | 8/1967 | Scott | 338/126 |
| 3,617,976 | 11/1977 | Campbell | 338/161 |
| 4,060,789 | 11/1977 | Achtmann et al. | 338/176 X |

*Primary Examiner*—C. L. Albritton

*Attorney, Agent, or Firm*—Guy W. Shoup; Gerard F. Dunne

[57] ABSTRACT

A variable impedance device wherein a plurality of elongate conductor leads extend longitudinally from an impedance element carried on an insulating substrate, and slide members are moved on the conductor leads, thereby to short-circuit or disconnect predetermined parts of the impedance element so as to obtain various impedance values.

15 Claims, 7 Drawing Figures

VARIABLE IMPEDANCE DEVICE

BACKGROUND OF THE INVENTION

This invention relates to variable impedance devices, and more particularly to variable impedance devices wherein an impedance value such as resistance can be varied stepwise and arbitrarily.

In many prior art variable resistors, the resistance is varied continuously from lower values towards higher values or from higher values towards lower values. There are also variable, resistors such as attenuators for audio equipment, wherein the resistance is varied stepwise from lower values towards higher values or conversely. However, in these devices stepwise variation of a resistance is often accomplished by only complicated arrangements and the resistance cannot be varied arbitrarily when a lever or rotary shaft of the device is operated in one direction only. Also, there is need for a device in which an inductance or capacitance value can be varied in this manner. Furthermore, there is need for a variable impedance device in which an inductance can be made to appear between terminals at one time, a capacitance can be made to appear on another ocassion and a composite value consisting of a capacitance and a resistance can be made to appear on still another occasion.

SUMMARY OF THE INVENTION

It is accordingly an object of this invention to provide a variable impedance device wherein the impedance can arbitrarily be varied by the operation of an operating portion in one direction.

Another object of this invention is to provide a variable impedance device wherein the impedance can be varied in a manner of discontinuous steps.

Still another object of this invention is to provide a variable impedance device wherein impedance including a resistance, an inductance or a capacitance value can be varied.

Still another object of this invention is to provide a variable impedance device in which the impedance can be changed without bringing a sliding member into direct contact with an impedance element.

In order to accomplish the objects, according to one aspect of performance of the variable impedance device of this invention, a plurality of impedance elements carried on an insulating substrate are connected in series, and elongate conductor leads extend from the junctures of the impedance elements along sliding paths of slide members, whereby the ends of the impedance elements may be short-circuited or disconnected by means of the slide member by moving it, whereby the impedance elements may be combined to obtain several impedance values.

DESCRIPTION OF THE PREFERRED EMBODIMENTS

Figure 1:
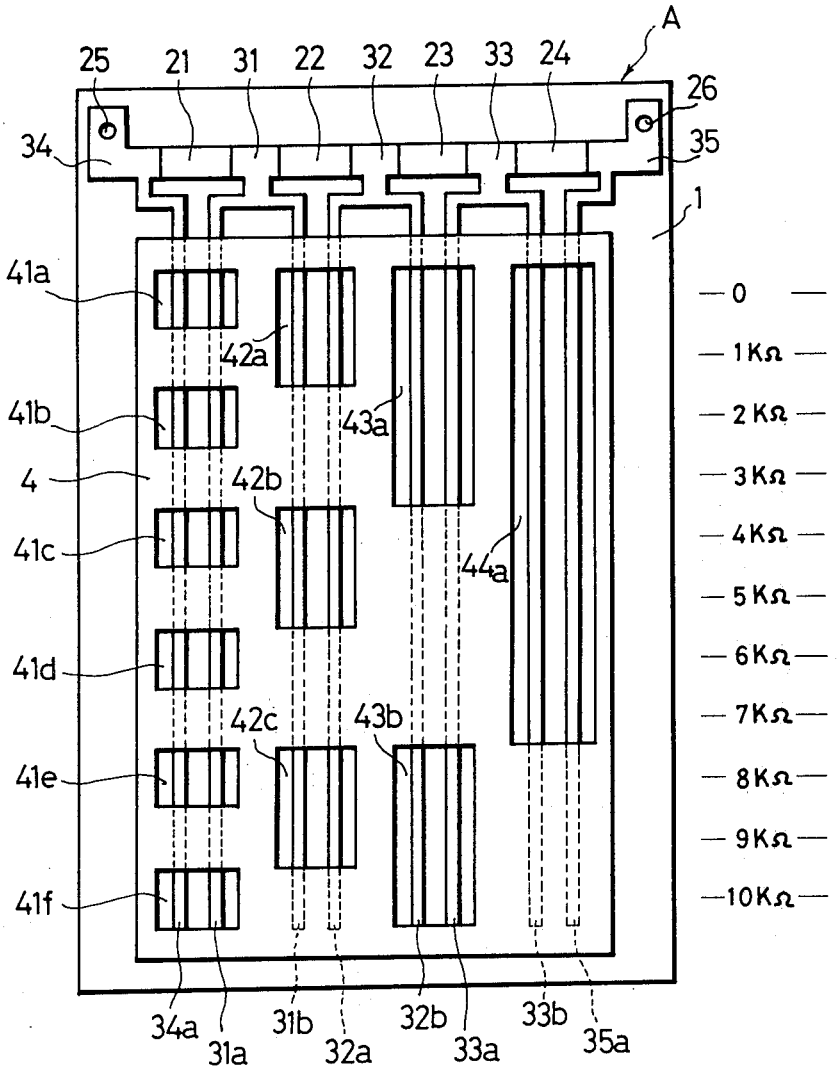
FIG. 1 is a front view which shows a base plate of a variable resistor according to this invention.

Referring to FIG. 1, a base plate A has an insulating substrate 1 made from a phenolic resin lamination plate. Four resistor layers 21, 22, 23 and 24 are deposited on the insulating substrate 1. Conductor layers 31, 32 and 33 for connecting the resistor layers are deposited between the respectively adjacent resistor layers. Further, conductor layers 34 and 35 are respectively deposited at ends of the resistor layers 21 and 24 and are connected electrically with respective terminal holes 25 or 26 each adapted to receive respective terminals.

Each of the conductor layers has at least one elongate conductive lead extending longitudinally along the substrate. More specifically, conductor lead 34*a* extends from the conductor layer 34 in the longitudinal direction of the insulating substrate 1. A conductor lead 31*a* extends from the conductor layer 31 and runs in proximity to, and in parallel relation with, the conductor lead 34*a*. Further, a conductor lead 31*b* also extends from the conductor layer 31 and runs parallel to but is spaced from the conductor lead 31*a*. Extending from the conductive layer 32 is a conductor lead 32*a* running in parallel proximity to the conductor lead 31*b* and a conductor lead 32*b* spaced from the conductor lead 32*a* in parallel relation therewith. A conductor lead 33*a* extends from the conductor layer 33 and runs in closely parallel relation to the conductor lead 32*b*, and a conductor lead 33*b* extends from the conductor layer 33 in parallel spaced relation from the conductor lead 33*a*. Lastly, a conductor lead 35*a* runs in parallel proximity to the conductor lead 33*b* and extends from the conductor layer 35.

Numeral 4 designates a thin insulating film which is deposited by known techniques on the conductor leads. Six windows 41*a* to 41*f* are provided in parts of the insulating film 4 overlaying the conductor leads 34*a* and 31*a*, three windows 42*a* to 42*c* are provided in parts of the insulating film 4 overlying the conductor leads 31*b* and 32*a*, two windows 43*a* and 43*b* are provided in parts of the insulating film 4 overlying the conductor leads 32*b* and 33*a*, and a single window 44*a* is provided in a part of the insulating film 4 overlying the conductor leads 33*b* and 35*a*. The windows are each formed in a predetermined size for purposes to be set forth more fully below.

Figure 2:
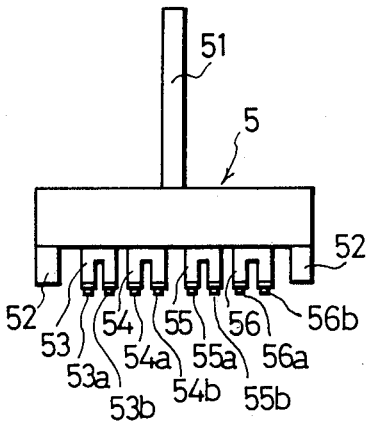
FIG. 2 is a side view of a slide member-receiver for use in the variable resistor in FIG. 1.
Figure 3:
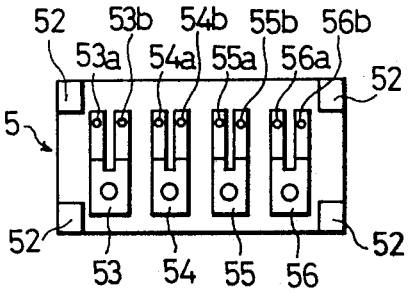
FIG. 3 is a bottom view of the slide member-receiver in FIG. 2.

In this invention, a slide member having slide portions moves along the conductor leads disposed on the insulating substrate 1. FIG. 2 is a side view showing the slide member, while FIG. 3 is a bottom view thereof. The slide member 5 is made of an insulator. A lever 51 protrudes from the upper surface of the receiver proper 5, and respective protuberances 52 are disposed on the four corners of the bottom surface. The four slide portions 53, 54, 55 and 56 are mounted on this bottom surface. The fore ends of each slide portion is provided with respective pairs of contactors 53*a* and 53*b*, 54*a* and 54*b*, 55*a* and 55*b*, and 56*a* and 56*b*. When the slide member 5 is placed on the insulating substrate 1, the contactor 53*a* overlies the conductor lead 34*a*, the contactor 53*b* overlies the conductor lead 31*a*, the contactor 54*a* overlies the conductor lead 31*b*, the contactor 54*b* overlies the conductor lead 32*a*, the contactor 55*a* overlies the conductor lead 32*b*, the contactor 55*b* overlies the conductor lead 33*a*, the contactor 56*a* overlies the conductor lead 33*b*, and the contactor 56*b* overlies the conductor lead 35*a*.

Figure 4:
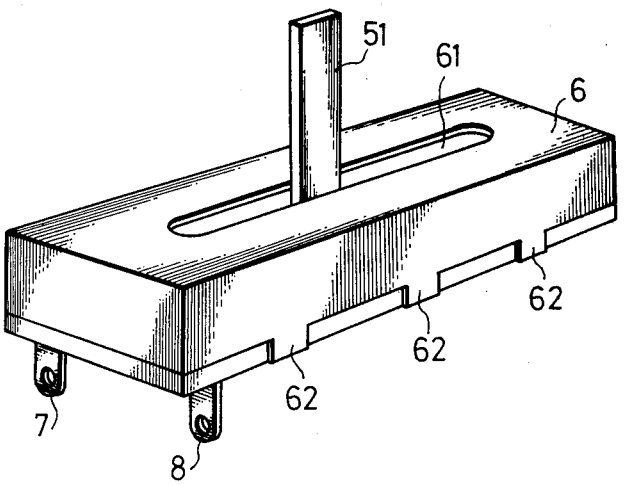
FIG. 4 is a perspective view which shows the external appearance of the variable resistor in FIG. 1.

In actuality, after the slide member 5 has been placed on the insulating substrate 1, a cover 6 is placed thereover with the lever 51 projecting through a slit 61 of the cover 6, as shown in FIG. 4. Although not shown in the figures, a detent mechanism for locating the slide member 5 to a predetermined position is also included. In FIG. 4, the numerals 62 indicate engaging pieces with which the cover 6 is provided for securing it in position. Numerals 7 and 8 indicate the terminals which are respectively mounted in the terminals holes 25 and 26.

Now, the operation of the embodiment of this invention will be explained. It is supposed by way of example that the resistance of the resistor layer 21 is 1 [KΩ], that the resistance of the resistor layer 22 is 2 [KΩ], that the resistance of the resistor layer 23 is 4 [KΩ], and that the resistance of the resistor layer 24 is 8 [KΩ]. When the slide member 5 is stopped at a position (0) in FIG. 1, the slide portion 53 interconnects the conductor leads 43*a* and 31*a*, the slide portion 54 connects the conductor leads 31*b* and 32*a*, the slide portion 55 connects the conductor leads 32*b* and 33*a*, and the slide portion 56 connects the conductor leads 33*b* and 35*a*, so that the resistance between the conductor layers 34 and 35 becomes zero. When the slide member 5 is stopped at a position (1 KΩ), the slide portion 53 has its electrical contact with the conductor leads 34*a* and 31*a* released by the insulating film 4, so that the resistor layer 21 is connected between the terminals 7 and 8 and the resistance therebetween becomes 1 [KΩ]. When the slide member 5 is thereafter moved similarly, the resistance between the terminals 7 and 8 varies up to 10 [KΩ] stepwise at intervals of 1 [KΩ]. In this embodiment, the resistance between the terminals 7 and 8 has been made stepwise variable from 0 to 10 [KΩ]. However, when the insulating substrate 1 and the respective conductor leads are extended and the number of the windows in the insulating film 4 is increased, the resistance can be varied stepwise up to 16 [KΩ] at the intervals of 1 [KΩ]. By changing the windowing positions of the insulating film 4 and changing the combination of the resistor layers, random resistance variations can be bestowed in such a manner that, for example, the resistance between the terminals is zero at the first position of the slide member, is 10 [KΩ] at the second position, it being 2 [KΩ] at the third position, is 16 [KΩ] at the fourth position.

Figure 5:
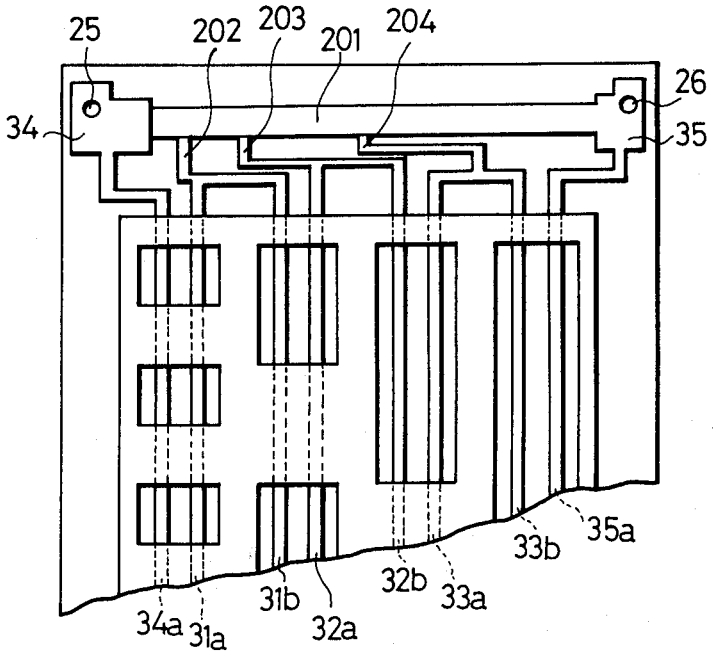
FIG. 5 is a front view, partially broken away, of a base plate in another embodiment of the variable resistor according to this invention.

In all the above embodiments, the four resistor layers have been connected by the conductor layers. As shown in FIG. 5, however, it is possible to employ a single resistor 201, and have terminals 202, 203 and 204 extend from any desired points of the resistor 201, and to connect these terminals to the respective conductor leads.

In FIG. 1, each pair of the conductor leads 31*a* and 31*b*, 32*a* and 32*b*, and 33*a* and 33*b* can also be made as a wide single conductor lead.

Figure 6:
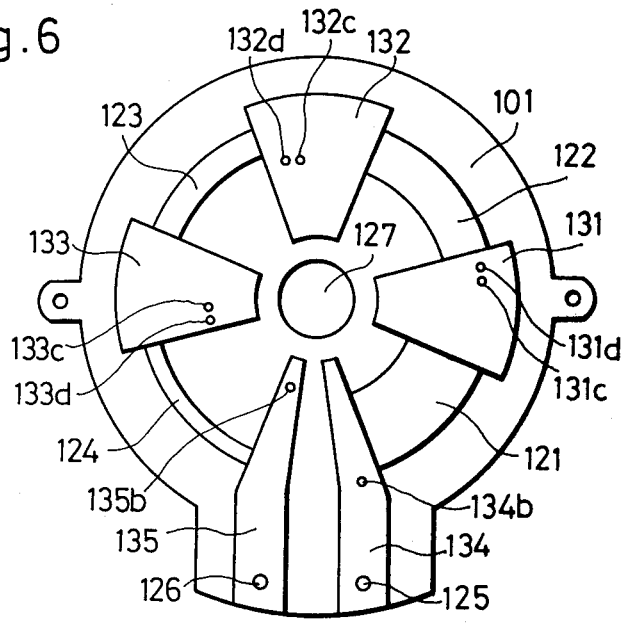
FIG. 6 is a front view of a base plate in still another embodiment of this invention.
Figure 7:
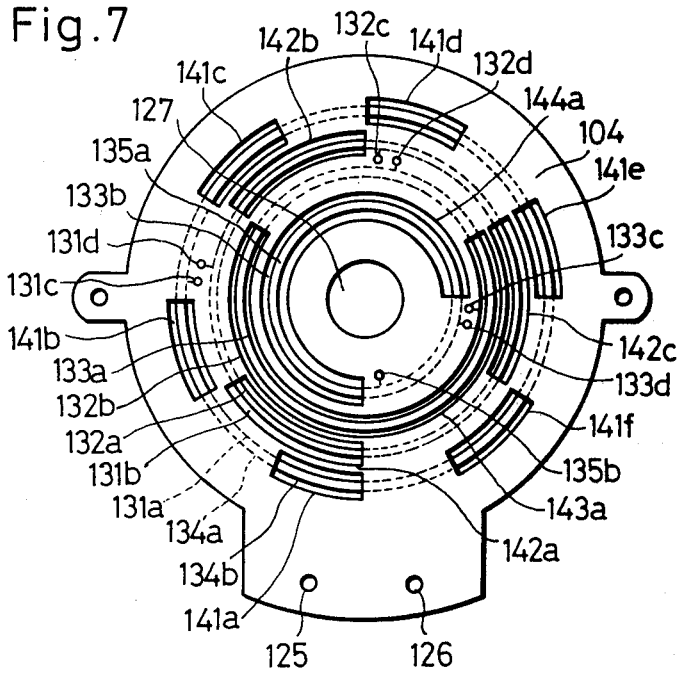
FIG. 7 is a rear view of the base plate in FIG. 6.

FIG. 6 is a front view of an insulating substrate showing an embodiment in the case where this invention is applied to a rotary type variable resistor, while FIG. 7 is a rear view thereof. Referring to FIGS. 6 and 7, numeral 101 generally designates the insulating substrate. Four resistor layers 121, 122, 123 and 124 are deposited on the front surface of the insulating substrate 101. Between the adjacent resistor layers, conductor layers 131, 132 and 133 which connect them are deposited. Further, conductor layers 134 and 135 are respectively deposited at ends of the resistor layers 121 and 124, and include terminal holes 125 and 126 for receiving respective terminals. The conductor layer 131 is provided with two holes 131*c* and 131*d* therethrough, the conductor layer 132 is provided with two holes 132*c* and 132*d* therethrough, the conductor layer 133 is provided with two holes 133*c* and 133*d* therethrough, the conductor layer 134 is provided with a through-hole 134*b* therethrough, and the conductor layer 135 is provided with a hole 135*b* therethrough. As shown in FIG. 7, eight conductor leads 131*a*, 131*b*, 132*a*, 132*b*, 133*a*, 133*b*, 134*a* and 135*a* are concentrically disposed on the rear surface of the insulating substrate 1. Among the conductor leads, those 134*a* and 131*a*, 131*b* and 132*a*, 132*b* and 133*a*, and 133*b* and 135*a* are close to each other. The conductor lead 134*a* is connected with the conductor layer 134 through the hole 134*b*, the conductor leads 131*a* and 131*b* are connected with the conductor layer 131 through the holes 131*c* and 131*d* respectively, the conductor leads 132*a* and 132*b* are connected with the conductor layer 132 through the holes 132*c* and 132*d* respectively, the conductor leads 133*a* and 133*b* are connected with the conductor layer 133 through the holes 133*c* and 133*d* respectively, and the conductor lead 135*a* is connected with the conductor layer 135 through the hole 135*b*. Numeral 104 indicates a thin insulating film which is deposited over the conductor leads. Six windows 141*a* to 141*f* are provided in the part of the insulating film 104 overlying the conductor leads 134*a* and 131*a*, three windows 142*a* to 142*c* are provided in the part of the insulating film 104 overlying the conductor leads 131*b* and 132*a*, a single window 143*a* is provided in the part of the insulating film 104 overlying the conductor leads 132*b* and 133*a*, and a single window 144*a* is provided in the part of the insulating film 104 overlying the conductor leads 133*b* and 135*a*.

In this embodiment, the insulating substrate 101 is assembled in a fitting plate provided with a detent mechanism in the same manner as a fixed contact wafer of a rotary switch, a slide member in the shape of a disc is mounted on a rotary shaft which is inserted through a shaft inserting hole 127 provided at the center of the insulating substrate 101, four slide portions each of which is adapted to short-circuit the corresponding two close conductor leads on the insulating substrate 101 are attached to the slide member, and the slide portions are slid on the corresponding conductor leads by rotating the rotary shaft, whereby the resistance between the terminals mounted in the terminal holes 125 and 126 is varied stepwise as in the first embodiment. Also in this embodiment, it is a matter of course that when the positions of the windows in the insulating film 104 are changed, multifarious resistance values can be varied at random as in the first embodiment. Needless to say, the rotary shaft is provided with the detent mechanism similar to that of the rotary switch, and it is stabilized at the respective step positions.

Although, in the above embodiment, the number of the resistor layers has been four, it may be made two, three, or five or more as well. Besides, the resistances of these resistor layers do not need to be stepped values such as $2^0, 2^1, 2^2 \ldots$, but they may be various values and multifarious resistances can be offered by combining them.

In any of the foregoing embodiments, the resistance has been varied. Needless to say, however, when capacitors or coils are connected instead of the resistor layers in each of the embodiments, a variable capacitance device or a variable inductance device can be provided in a manner similar to the variable resistance device. Especially in case of the variable capacitance device or the variable inductance device, when a coil or a capacitor is connected outside of the device, the resultant device can also be utilized as a tuner. In addition, the impedance elements to be carried on the insulating substrate are not restricted to any one sort of resistors, capacitor and coils, but desired elements among them may be mixed and carried.

As described above in detail, according to this invention, conductor leads extending from respective ends of a plurality of impedance elements are selectively short-circuited by a plurality of slide portions, whereby the impedance elements can be combined multifariously. Therefore, the value of an impedance can be varied stepwise from lower values towards higher values or conversely upon the operation of an operating portion in one direction. Moreover, it is also possible to vary the impedance value at random. Accordingly, this invention has very high values of uses as an attenuator, a tuner and an equalizer. In case of the embodiments of variable resistors, the slide members do not slide on the resistor layers as in conventional variable resistors, so that the resistor layers do not wear away at all. In this point, the life of the variable resistance device can be greatly prolonged.

What is claimed is:

1. A variable impedance device, comprising:

a substrate;

an impedance element carried on said substrate;

a plurality of pair of conductor leads disposed on said substrate and extending from predetermined portions of said impedance element;

a group of slide members corresponding to respective pairs of said conductor leads and adapted to slide on said respective pairs, said each slide member being adapted to short-circuit the corresponding pair of said conductor leads; and insulating means disposed on slide paths of said slide members and for preventing contact between said slide members and said conductor leads at predetermined positions on said conductor leads.

2. A variable impedance device according to claim 1, wherein said impedance element is composed of a plurality of impedance elements connected in series.

3. A variable impedance device according to claim 2, wherein said plurality of pairs of conductor leads extend from respective ends of said plurality of impedance elements.

4. A variable impedance device according to claim 1, wherein said insulating means is an insulating film printed on said conductor leads.

5. A variable impedance according to claim 4, wherein said insulating means further includes openings for allowing contact with said conductor leads.

6. A variable impedance device according to claim 1, wherein the respective pairs of said conductor leads are arranged in proximity on said substrate.

7. A variable impedance device according to claim 6, wherein the conductor leads extending from electrically-equivalent portions of said impedance element form a single wide common conductor lead.

8. A variable impedance device according to claim 1, wherein said pairs of conductor leads are arranged rectilinearly and in parallel.

9. A variable impedance device according to claim 1, wherein said pairs of conductor leads are arranged concentrically.

10. A variable impedance device according to claim 9, wherein said conductor leads and said insulating means are arranged on one surface of said substrate, and said impedance element is arranged on the other surface of said substrate.

11. A variable impedance device according to claim 10, wherein said conductor leads and said impedance element are electrically connected by holes which penetrate through said substrate.

12. A variable impedance device according to claim 1, wherein said impedance element is made from a resistor.

13. A variable impedance device according to claim 1, wherein said impedance element is made of a combination of a resistor and at least one other impedance element selected from a group consisting of capacitance and inductance elements.

14. A variable impedance device according to claim 1, wherein said conductor leads are disposed on said substrate by printing means.

15. A variable impedance device according to claim 12, wherein said resistor is disposed on said substrate by printing means.

* * * * *